US005392216A

United States Patent [19]

Bystrianyk et al.

[11] Patent Number: 5,392,216

[45] Date of Patent: Feb. 21, 1995

[54] AUTOMATIC SELECTION OF POSTAGE METER PRINT ELEMENT BASED ON MAIL CLASS SELECTION

[75] Inventors: Roman Bystrianyk, West Haven; Jacqueline Collins, Bridgeport; Terrence M. Doeberl, West Redding; Kevin D. Hunter, Stratford, all of Conn.

[73] Assignee: Pitney Bowes Inc., Stamford, Conn.

[21] Appl. No.: 796,199

[22] Filed: Nov. 22, 1991

[51] Int. Cl.[6] ..... G07B 17/00

[52] U.S. Cl. ..... 364/464.02; 364/464.03

[58] Field of Search ..... 364/464.02, 464.03

[56] References Cited

U.S. PATENT DOCUMENTS

| | | | |
|---|---|---|---|
| 4,495,581 | 1/1985 | Piccione | 364/464.03 |
| 4,511,793 | 4/1985 | Racanelli | 364/466 X |
| 4,812,994 | 3/1989 | Taylor et al. | 364/464.02 |
| 4,956,782 | 9/1990 | Freeman et al. | 364/464.02 X |
| 5,072,397 | 12/1991 | Barns-Slavin et al. | 364/464.02 |
| 5,117,364 | 5/1992 | Barns-Slavin et al. | 364/464.03 |
| 5,121,327 | 6/1992 | Salazar | 364/464.02 |
| 5,293,310 | 3/1994 | Carroll ET AL. | 364/408 |

*Primary Examiner*—Edward R. Cosimano

*Attorney, Agent, or Firm*—Charles G. Parks, Jr.; Melvin J. Scolnick

[57] ABSTRACT

The mailing processing system includes a postage meter for dispensing postage. The postage meter includes having a printing mechanism having value print elements and a postal inscription mechanism. The postal inscription mechanism has a plurality of printing surfaces. Each surface is embossed with a different mail class identifier. The mail processing system inclusive of the postage meter operates under the control of a microcomputer means for accounting for postage dispensed by the postage meter having accounting means for providing department accounting of said dispensed postage and for controlling said printing means. The microcomputer is programmed to enable permitted carrier and carrier fees sets in accordance with operator selected departmental account. The microcomputer is being further programmed to cause said postal inscription mechanism to position said respective printing surface for printing corresponding to the carrier class selected by said operator.

5 Claims, 8 Drawing Sheets

PHYSICS DEPARTMENT

CARRIER SET

{ABC, C1 ... C10, CLASS D ... CLASS AA}
{DEF, C1 ... C20, CLASS B ... CLASS BB}
⋮
{XYZ, C1 ... C10, CLASS X ... CLASS XX}

AUTOMATIC SELECTION OF POSTAGE METER PRINT ELEMENT BASED ON MAIL CLASS SELECTION

RELATED APPLICATION

This application is related to U.S. patent application Ser. No. 629,796, filed Dec. 19, 1990 entitled "User Interface For A Mail Processing System", which is now abandoned and has been continued as U.S. application Ser. No. 210,651, filed Mar. 21, 1994.

BACKGROUND OF THE INVENTION

The present invention relates to a microcomputer based mail processing system having internal departmental accounting and meter printing means. Typically, a postage meter has an accounting system for accounting of gross funds expendid and gross funds available for posting. Examples of such systems are discussed in U.S. Pat. Nos. 4,251,874 and 4,253,014, which are assigned to the assignee of the present application and are herein incorporated by reference.

It is known to provide a postage metering mailing machine with the capability of posting mail in a plurality of postal classes. Conventionally, a postage meter having the capability of posting mail in more than one postal class uses a postal inscription, also known as a multi-slogan. The postage meter is configured with a first set of printing elements for printing the postage fee on the envelope to be posted. Optionally, the mailing machine postage meter may also contain an additional print element referred to postal inscription for postal class identification. The postal inscription print mechanism is conventionally constructed to have two or more print surfaces, thereby allowing an operator to manually select the desired inscription for the posting mail piece or envelope.

SUMMARY OF THE INVENTION

It is an object of the present invention to present a postage meter having a postal inscription identifying of a postal class. The postage meter includes a human interface system which has the added functionality of allowing the operator to direct activation of the inscription printing mechanism and select which inscription will be set in the print position through the human interface system.

It is a further objective of the present invention to present a postage meter wherein the appropriate inscription printing surface alternatively is accomplished transparently to the operation upon the operator's selection of appropriate department accounting information prior to posting of envelopes by the housing mailing machine.

A particularly suitable postage meter mailing machine may include a feeder assembly for automatically feeding envelopes to the mailing machine in a serial manner for individually posting each envelope. The mailing machine preferably includes a user interface system having a display and keypad data entry. The microcomputer preferably employs a multi-processor architecture and is programmed to selectively enable mailing machine function and account by department for postage dispensed by the postage meter mailing machine.

In the most preferred embodiment of the invention, the microcomputer includes a non-volatile memory which has stored therein the respective carrier class and rate structure information. During machine set-up by authorized personnel, such as, the mail room supervisor or manufacturer's personnel, each account established has assigned a specific carrier set and for each carrier, a specific class and rate set. The class and rate set is comprised of the permissible mail class and fee range for the respective carrier mail classes.

During operation, the machine operator is presented with a menu option set which includes the option to enter a charging account number and select a carrier/-class, otherwise the accounting system will default to the last accessed account and carrier/class information. The operator may optionally view the permissible fees for the selected carrier/class for that account. Once the operator has chosen the desired account, the microcomputer verifies that the chosen carrier and class is valid for the chosen account carrier/class set and identifies the permissible fee range as specified in the account set. Once the carrier and class is verified by microcomputer, the operator may select the appropriate postal class. Upon selection of the mail class, the microcomputer instructs a print setting mechanism to actuate the postal inscription mechanism to position the corresponding printing surface into print position. The operator may then initiate mail posting by the mailing machine.

DETAILED DESCRIPTION OF THE PREFERRED EMBODIMENT

Figure 1:
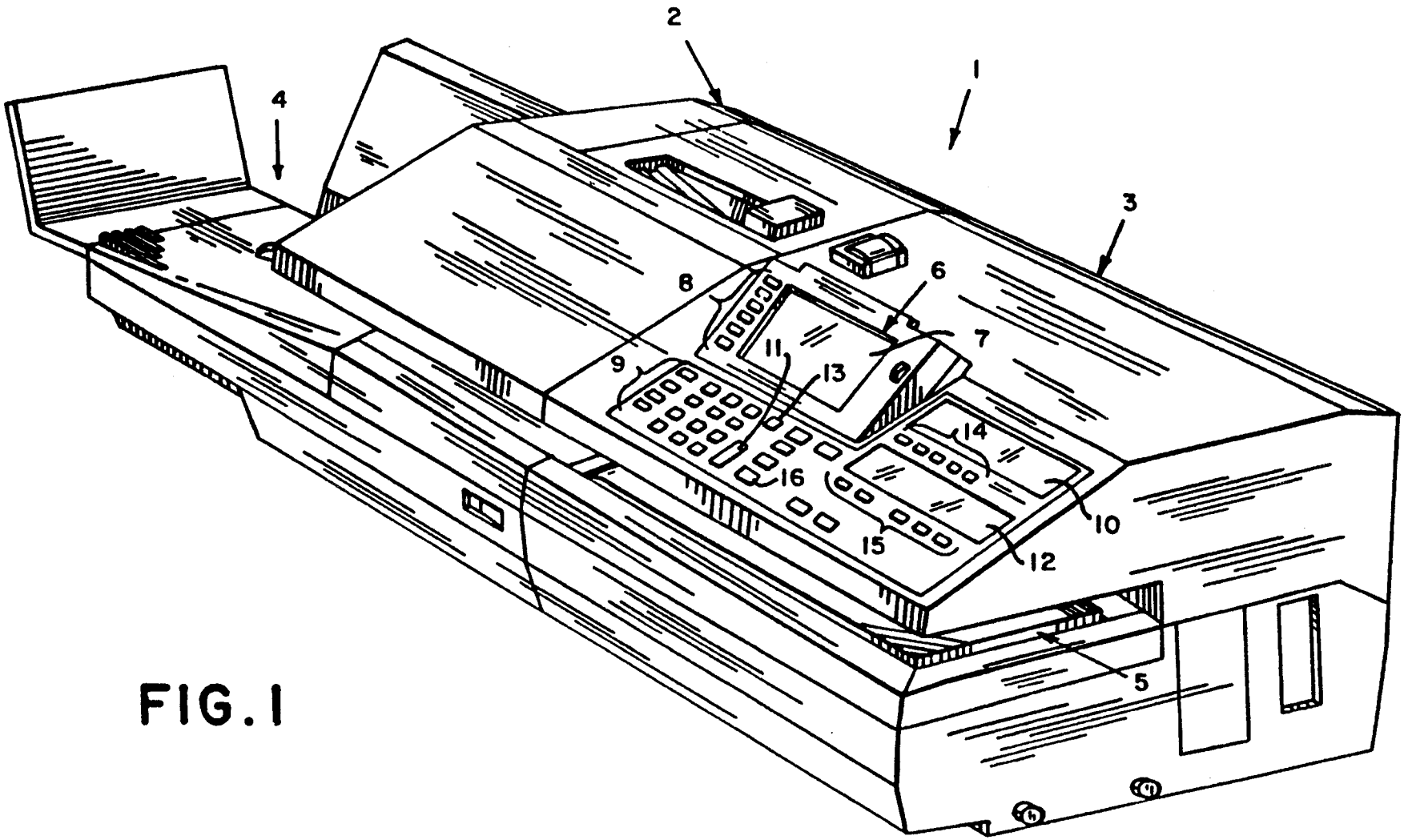
FIG. 1 is a schematic of microcomputer system for a mail processing system having a user interface system and accounting system in accordance with the present invention.

Referring to FIG. 1, the present invention is particularly suited for a postage meter mailing machine application. For example, a postage meter mailing machine, generally indicated as 1, is comprised of a feeder section 2 and a postage meter mailing machine section 3. In operation, envelopes are placed inn a hopper 4 of the feeder section 2, whereupon the envelopes are serially fed through the feeder section to the mailing machine section 3 for imprinting of a postage indicia on feed envelopes by a postage meter print arrangement (not shown) detachably mounted within the mailing machine section 3. In the preferred embodiment, the mailing machine 1 includes a scale 5 for weighing the envelope and communicating with a microcomputer system which controls the operation of the postage meter mailing machine such that proper postage is printed by the printing mechanism of the postage meter on the envelope according to the weight of the envelope.

The mailing machine 1 includes a user interface, generally indicated as 6. The user interface 6 includes a visual display 7 and a plurality of soft keys 8 aligned to a respective portion of the screen 7 and a plurality of hard keys 9, which form a keyboard or keypad, at least one of the keys 9 are designated as an enter key 11 and another designated as a return key 13. Also one of the hard keys is designated as a start 16. The interface 6 also includes first and second mimic displays 10 and 12, respectively. The mimic display also has associated function hard keys, generally indicated as 14 which are associated with the mimic display 10 and hard keys 15 which are associated with mimic display 12.

Figure 2:
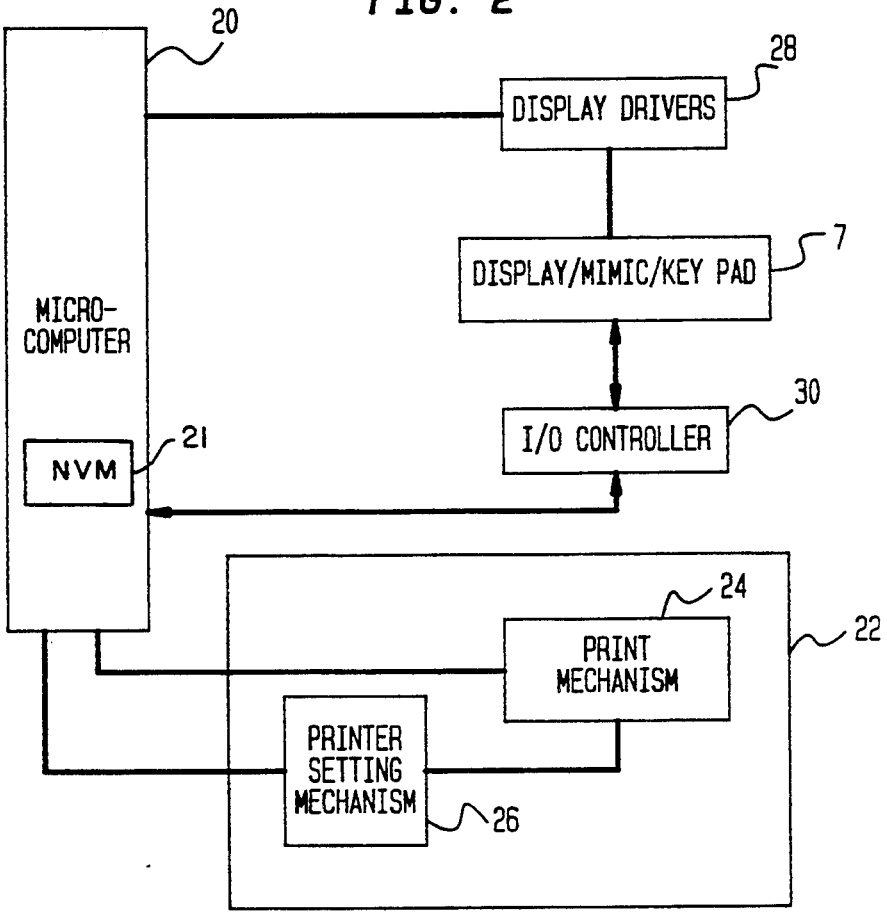
FIG. 2 is a schematic of a microcomputer system for a mail processing system suitable for controlling the user interface system and accounting system of the mail processing system in accordance with the present invention.

Referring to FIG. 2, for the purpose of simplifying the understanding of the invention, the mail processing system 1 is illustrated here under the control of a microcomputer 20. The microcomputer 20 is comprised of a plurality of programmable micro-processor based controller, memory units and suitable system interfaces (not here shown). A more detailed description of the microcomputer system of the mail processing system is set forth in U.S. patent application Ser. No. 629,796, which is abandoned and has been continued as U.S. application Ser. No. 210,651 filed Mar. 21, 1994, herein incorporated by reference. The microcomputer 20 is in communication with a meter unit, generally indicated as 22. The meter unit 22 includes a printing mechanism 24 under the control of a printing setting mechanism 26. The printing setting mechanism 26 is in communication with the microcomputer 20. The microcomputer 20 is also in communication with a display driver 28 which in turn controls the display 7. A input-output controller 30 is in communication with the display keypad 12 and the microcomputer 20.

Figure 3:
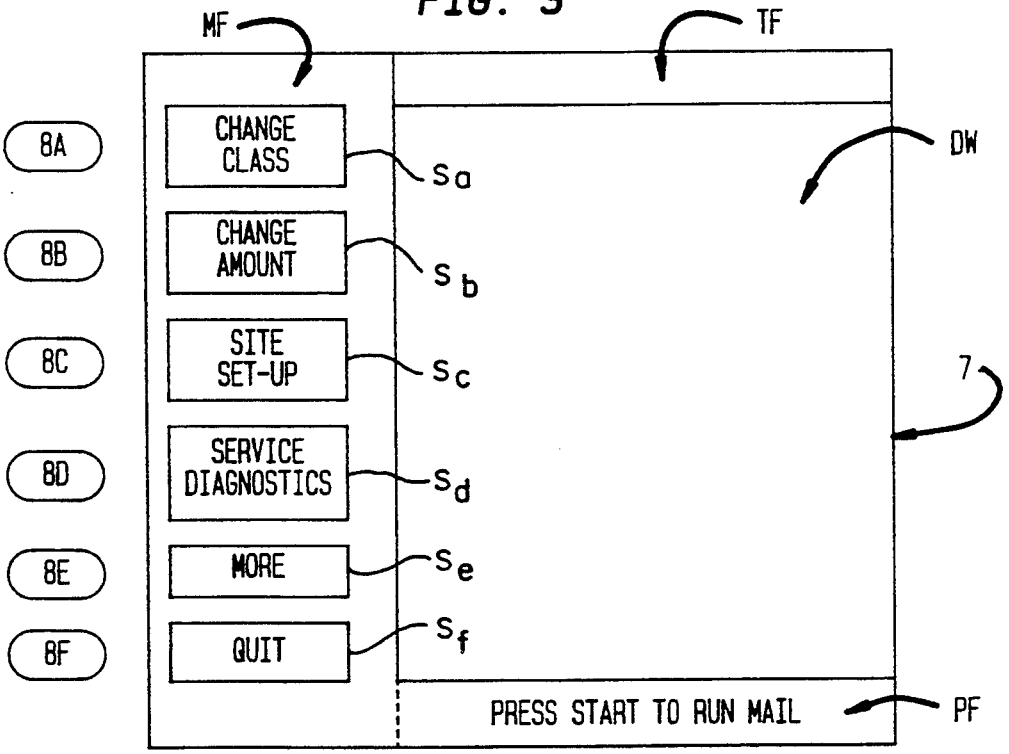
FIG. 3 is a schematic of a display for the mail processing system in accordance with the present invention.

Referring to FIG. 3, the display 7 is mapped such that each screen defines a data window area DW, a soft key menu field MF, a screen title field TF and a prompt/error field PF. The soft keys, individually referred as 8*a* through 8*f*, are each aligned to respective portions 5*a* through 5*f* of the screen menu field MF. Aligning the soft keys to a respective portion of the screen field MF in this manner allows a machine operator to easily associate the options presented in the menu field MF with the depression of the correspondingly aligned soft key. Operator instructions, request for operator variable data input and operator error messages are presented in the prompt field PF. Within the data window DW, user system information pertinent to the current state of the mailing machine 1 or selected soft function can be presented to the operator. It is noted that the soft functions refer to data processing functions, such as funds accounting, and hard functions refer to machine control functions.

Figure 5:
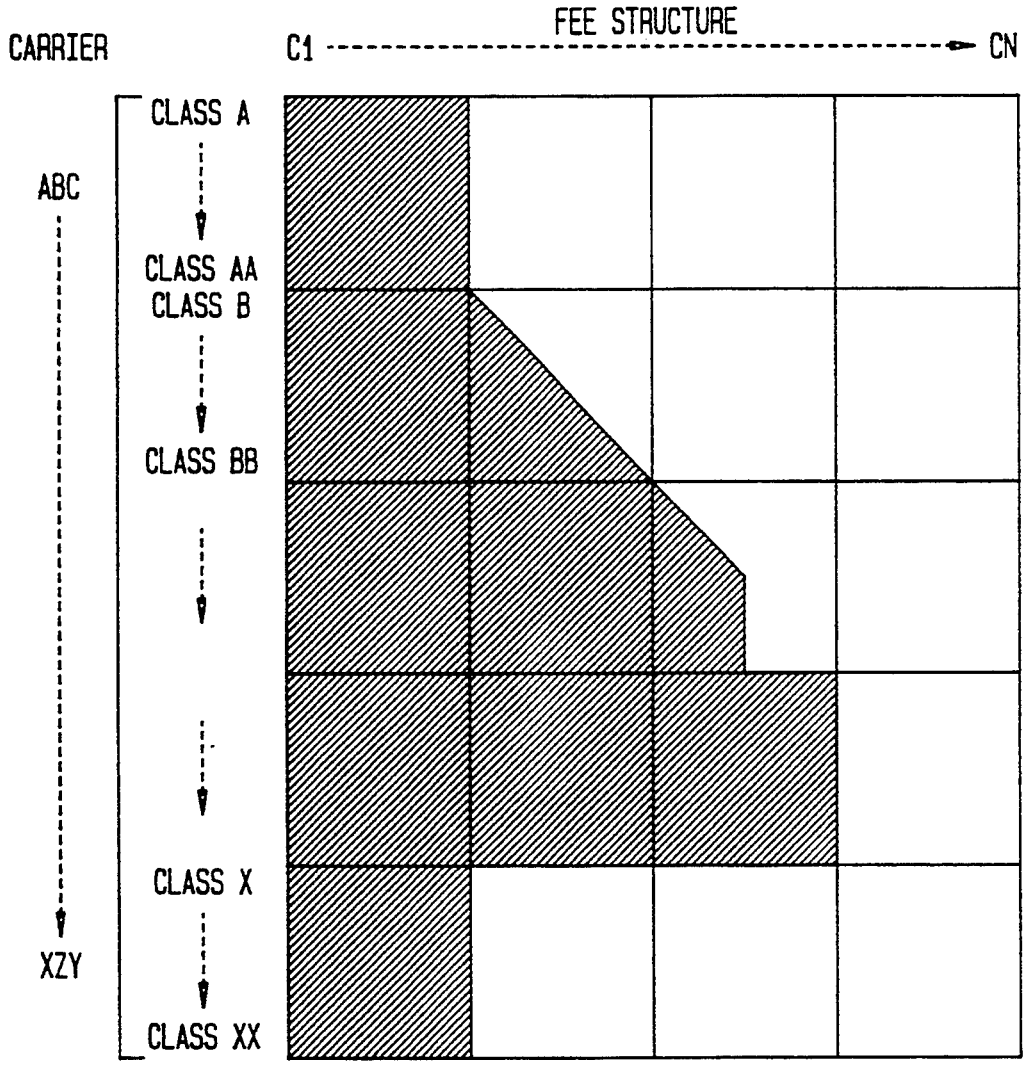
FIG. 5 is a schematic of the departmental account criteria in accordance with the present invention.

Illustrated in FIG. 5 is a schematic of the carrier fee table structure which is preferably stored in the nonvolatile memory (NVM) 21 of the microcomputer 20. Represented within the enclosed area is the fee associated with each respective carrier (ABC through XYZ). Each carrier has a plurality of classes (e.g., Class A through AA). Each class has an associated range of fees (e.g., C1 through CN) associated with each class. As an example, Class BB may be assigned to a private carrier for two day service. The specific fee may be determined by weight of the item to be posted. In the more preferred embodiment of the invention, the item weight is obtained from the scale 5. As illustrated, a department (e.g., Physic Department) may be assigned, during account set up, a carrier set.

Figure 4A:
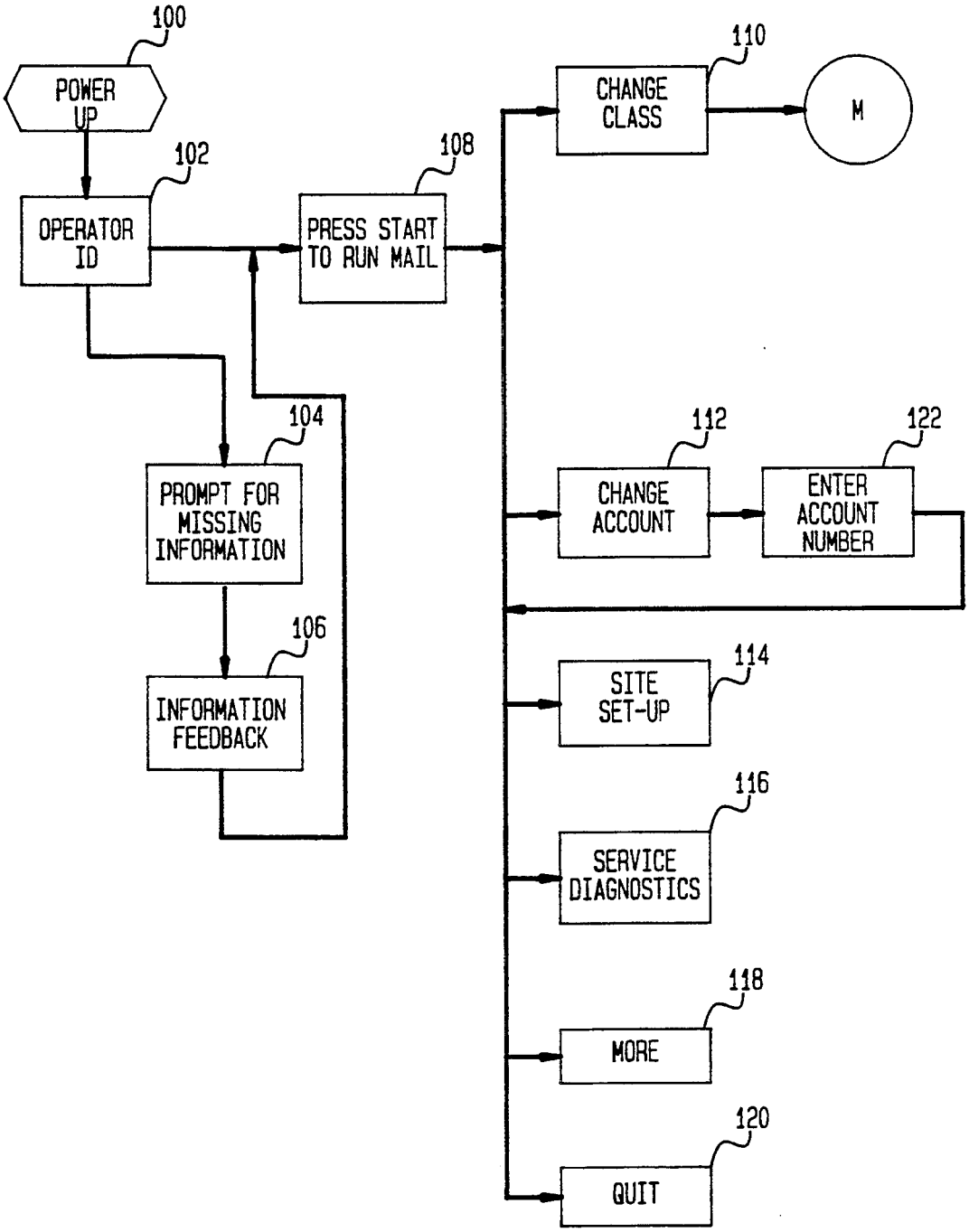
FIGS. 4A and 4B is a partial schematic of the user interface display logic in accordance with the present invention.
Figure 4B:
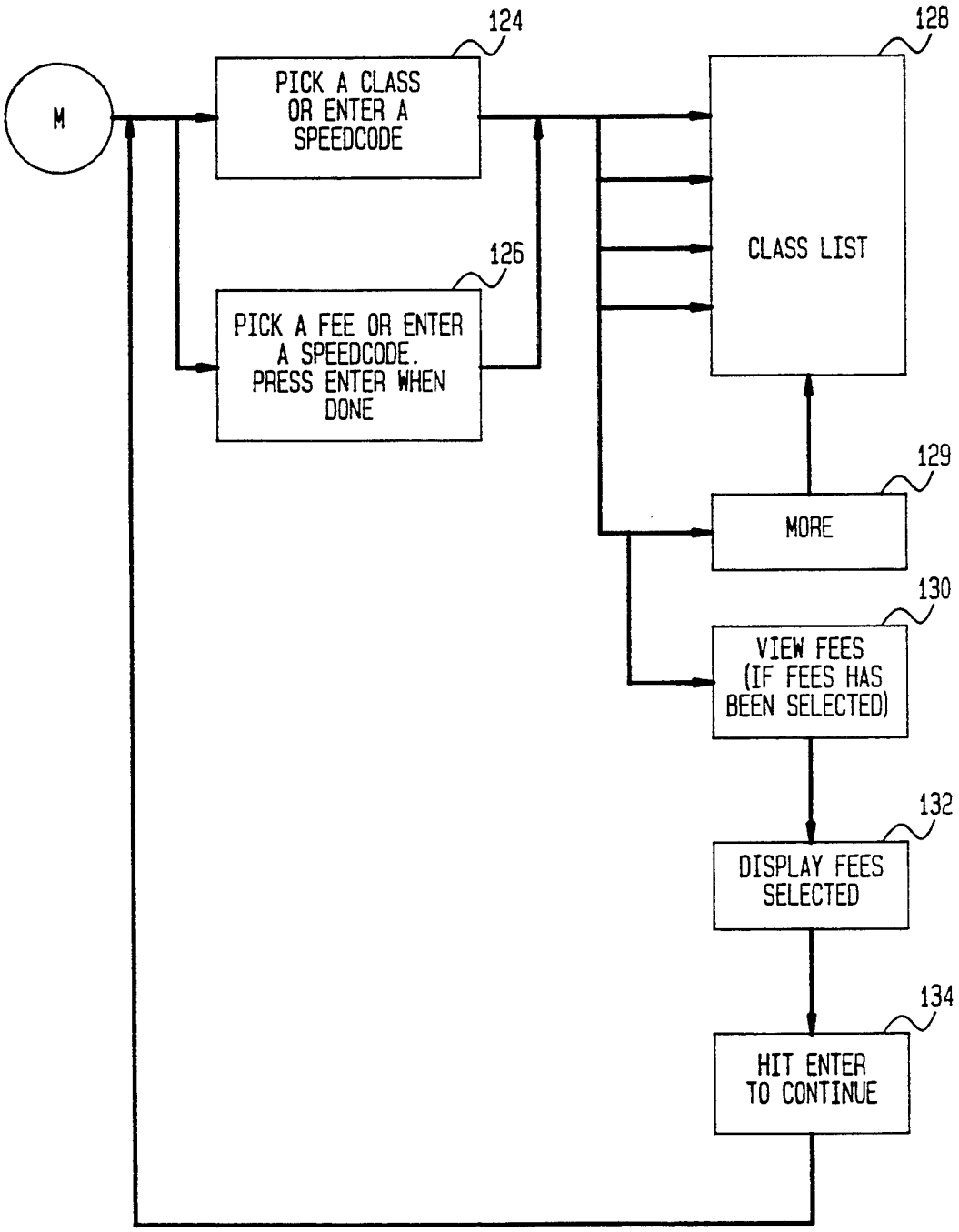

Referring to FIGS. 4A and 4B, and briefly here described, upon initialization of power to the system operator at 100, the microcomputer 20 causes the display 7 within the prompt field PF to prompt the operator to enter the operator identification number at 102. If the operator enters correct information, the operator is then prompted to press start to run mail at 108. If the operator enters erroneous information, the operator is then prompted at 104 to re-enter the proper information. The re-entered information is verified at 106, subsequent to which the operator is prompted to press start to run mail at 108. The operator is also presented with a menu in the menu field MF consisting of: change class at 110, change accounts at 112, site set-up at 114, service diagnostics at 116, access to additional menu options at 118 or quit at 120.

For the purposes of the present invention, the operator may choose to change accounts at 112, hereafter the operator is prompted to enter the new account number at 122. Upon operator entry of the new account number, the operator may choose to change the postal class. Should the operator choose to change the postal class at 110, the operator is prompted to pick postal class or enter a speed code at 124. A speed code is a short cut data entry method to identify an account number. An example is speed code 5 identifies a particular account number. The operator is also presented with the option to pick a fee at 126.

The operator is then presented with the available postal class for that account at 128. If the operator has chosen to pick a fee, the operator is presented with the option to view fees at 130. If there are more postal classes or fees than can be presented at one time, then the operator is prompted to hit the more key at 129 to scroll the listing. The operator is then presented with the fees selected at 132 and prompted to hit the enter key to continue at 134. Should the operator select the enter key, the operator is again presented with the options of picking a class at 124 or picking a fee at 126. It should now be appreciated that an operator may choose a subset of the carrier class set from which to process the present mail run.

Figure 6A:
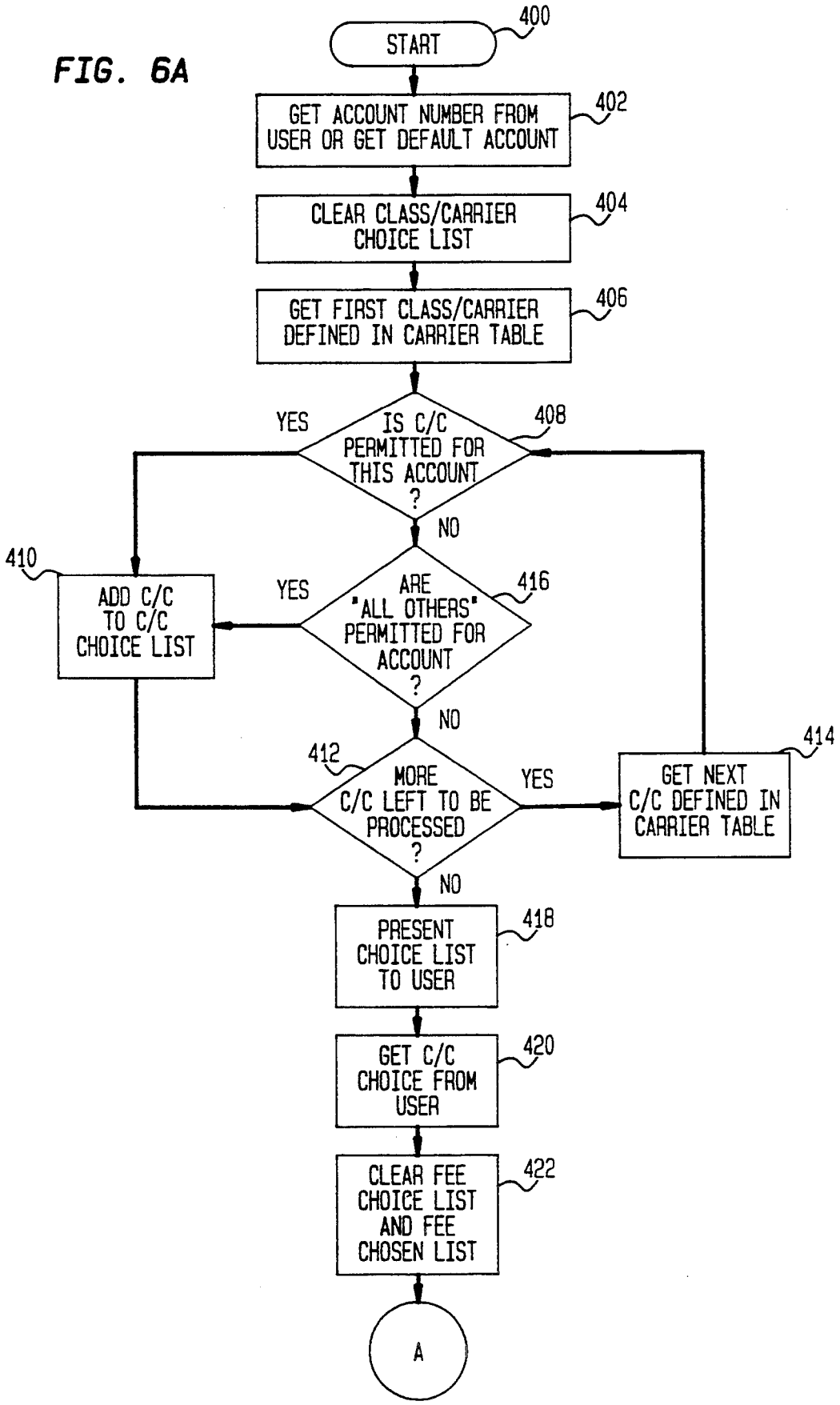
FIGS. 6A and 6B is a schematic of the logic flow for the departmental account function of the mail processing system in accordance with the present invention.
Figure 6B:
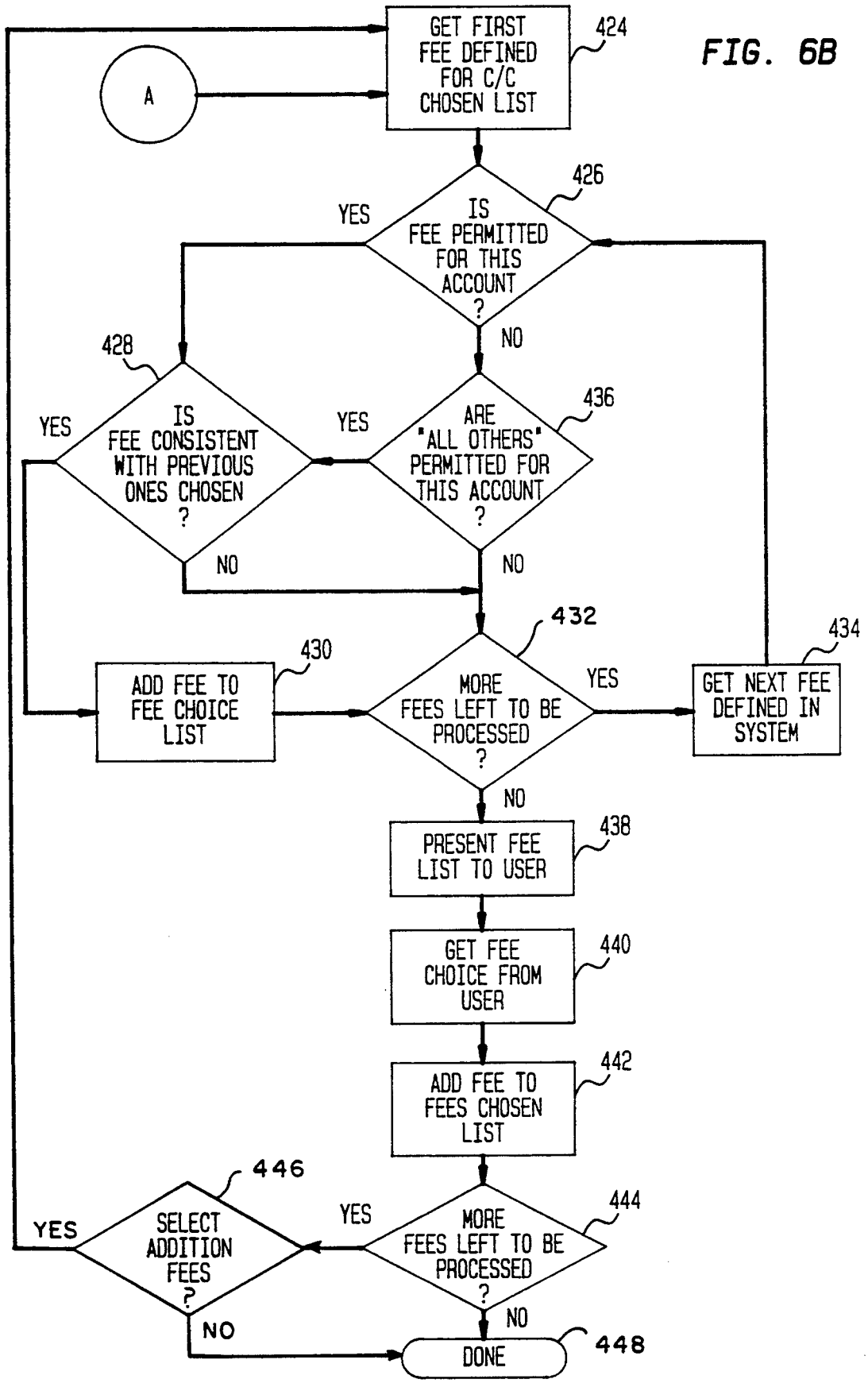

Referring to FIGS. 6A and 6B, after an operator has selected a new account or the default account as described above, the microcomputer is programmed to enter a routine at logic block 400. The operator inputs an account number, block 402, the routine then clears the class/carrier choice list at block 404. The routine retrieves from the carrier table, the first class/carrier defined in the carrier table at block 406. The class/carrier is then tested at block 408 to verify if it is permitted for the selected account. If the class is permitted for the selected account, the class is added to the class/carrier choice list at block 410. The routine then proceeds to test whether additional class/carriers remain to be processed at decision block 412. If additional classes remain, the next class/carrier of mail defined for the chosen account is obtained from the carrier table at logic block 414. The routine then returns to decision block 408 to verify if the class is permitted for the account.

If at decision block 408 it is determined that the class/carrier is not permitted for the selected account, the routine proceeds to decision block 416 to verify whether "All Others" class/carrier is permitted for the selected account. The "All Others" selection designates an account defined to include all class/carrier or all class/carriers with an exception. If an "All Others" category is permitted for the account, the routine proceeds to logic block 410 to contain in a loop until all the appropriate class/carriers have been enabled. If an "All Others" category is not permitted for the account, the routine proceeds again to decision block 412.

If at decision block 412, no additional class/carriers remain to be enabled, the operator is presented with a class/carrier of choice list at block 418. The operator then selects a class/carrier through the soft keys at block 420. The routine then clears the fee choice list and fees chosen list at block 422. The first fee defined in the account set for the class/carrier selected that is in the fees chosen list is obtained from the carrier table at block 424, and tested to verify if the fee is permitted for the account selected at decision block 426. If the fee is permitted, the routine proceeds to test the fee to determine if the fee is consistent with previous fees selected by the operator at decision block 428, using pre-defined postal rules, e.g., in the United States as set forth in the United States Postal Service Domestic Mail Manual. If the fee is consistent with previous fee selections, the fee is added to fee choice list at logic block 430. If the fee is not consistent with previous fee selections, the fee is not added to the fee choice list. The routine proceeds to decision block 432. If, at decision block 432, it is determined that there are fees remaining to be processed, the next fee selected is retrieved from the carrier table at block 434, wherefrom the routine returns to decision block 426. If at decision block 426 it is determined that a fee is not permitted for the selected account, the routine tests whether an "All Others" category is permitted for the account at decision block 436. If an "All Others" category is permitted for the account, the routine proceeds to decision block 428 and proceeds as described above. If an "All Others" category is not permitted for the account, processing continues at decision block 432.

If at decision block 432, it is determined that no further fees remain to be processed, the fee choice list is presented to the operator at block 438. The operator selects the desired fee, block 440. The routine adds the selected fee to the fees chosen list at block 442. The system then determines if any fees remain unselected by the operator at decision block 444, and if so, queries the operator, at decision block 446, whether additional fees are to be added to the fees chosen list. If the operator requires additional fees, the routine returns back to block 424 to begin the process of obtaining the additional fees. If at the decision block 444 no fees remain to be chosen or at decision block 446, the operator does not wish to add more fees, the process is completed at block 448.

Figure 7:
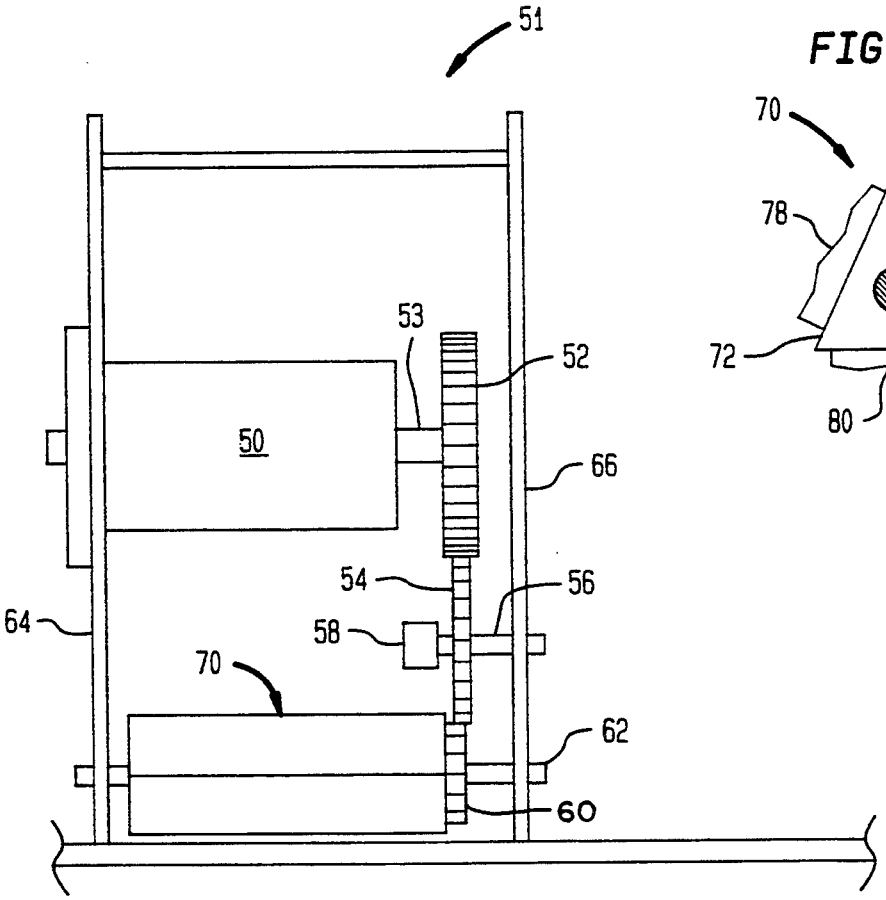
FIGS. 7 and *7a* is a schematic of the postal inscription mechanism with a setting mechanism in accordance with the present invention.

Referring to FIG. 7, the microcomputer 20 is programmed in response to the selected mail class to instruct the inscription setting mechanism 26 to initialize displacement of the setting motor 50 which is fixably mounted to a frame 51. The frame 51 is a form support structure of the postage meter mailing machine 3. A gear 52, fixably mounted to the output shaft 53 of the motor 50, is then caused to drive a transfer gear 54. The transfer gear 54 is rotatively mounted on the short shaft 56. One end of the short shaft 56 is fixably mounted to a support hub 58 which in turn is fixably mounted to a portion of the frame 51. The transfer gear 54 is in constant mesh with a gear 60. The gear 60 is fixably mounted to a shaft 62 which is rotatively mounted to frame 51 side walls 64 and 66. A postal inscription 70 is also fixably mounted to the shaft 62 such that the shaft 62 extends centrally through the postal inscription 70. As a result, rotation of the gear 52 causes responsive rotation of the gear 54, and in turn, gear 60. Rotation of gear 60 causes the shaft 62 to rotate and thereby rotatively position the postal inscription 70.

Figure 7A:
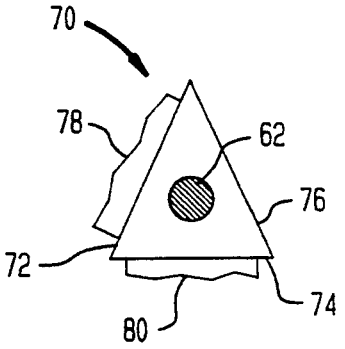

Referring to FIG. 7A, the postal inscription 70 in the preferred embodiment of the invention is comprised of three printing surfaces 72, 74 and 76. Each of the three printing surfaces 72, 74 and 73 may contain a postal inscription indicative of a mail delivery class. Print surface 72 has formed thereon conventional print elements 78 indicative of a first mail class. Print surface 74 has formed thereon conventional print elements 80 indicative of a second mail class. Print surface 76 optionally may be divorced of print elements such that when the postal inscription 70 is rotated into the print position by the motor 50 such that the print surface 76 is presented for printing, nothing is printed. Thereby allowing the operator to not print any postal inscription.

The above detailed description represents the most preferred embodiment of the present invention and should not be viewed as limiting. The full scope of the invention is set forth in the following claims.

What is claimed is:

1. An imp,roved mail processing system having a postage meter for dispensing postage under the control of a microcomputer, said postage meter having a printing means for printing postage information on an envelope, a secure funds accounting system for accounting of gross funds expendid and gross funds available for posting, a departmental accounting system for accounting of funds dispensed for each of a plurality of department accounts, and data entry means for providing operator entry of data to said microcomputer, wherein said improvement comprises:

said microcomputer having;

a first memory means for storing possible carrier, carrier class and carrier fee sets;

a second memory means for storing permitted carrier, carrier class and carrier fee sets assigned to each of said department accounts, said permitted sets are a subset of said possible sets; and said microcomputer being programmed, in response to said operator keying in through said data entry means one of said department accounts, to enable said permitted sets assigned to said keyed in department account and charge said keyed in department account for funds dispensed for said envelope and subsequent envelopes.

2. An improved mail processing system as claimed in claim 1 wherein said microcomputer being further programmed to permit a designated operator to establish said permitted sets for said department accounts.

3. An improved mail processing system as claimed in claim 1 wherein said first memory means and said second memory means are respective portions of a nonvolatile memory unit.

4. An improved mail processing system as claimed in claim 1 wherein said printing means is in communication with said microcomputer, said printing means comprises:

a plurality of postal inscriptions, said microcomputer being further programmed, in response to operator entry through said data entry means of a mail class from said permitted sets, to cause said printing means to select for printing on said envelope said postal inscriptions corresponding to said carrier class entered by said operator.

5. An improved mail processing system as claimed in claim 1 wherein said printing means includes:

a postal inscription mechanism having a plurality of printing surfaces, each of said printing surfaces having embossed thereon a respective postal inscription, said postal inscription mechanism is in communication with said microcomputer, said microcomputer being further programmed, in response to said operator entry through said data entry means of a mail class, to cause said postal inscription mechanism to position for printing on said envelope said printing surface corresponding to said carrier class entered by said operator.

* * * * *